US005858175A

United States Patent [19]

Feiler

[11] Patent Number: 5,858,175

[45] Date of Patent: Jan. 12, 1999

[54] SUCTION BOX WITH SIDE FILLERS

[75] Inventor: Bruno Feiler, Nattheim, Germany

[73] Assignee: Voith Sulzer Papiermaschinen, Heidenheim, Germany

[21] Appl. No.: 929,708

[22] Filed: Sep. 15, 1997

[30] Foreign Application Priority Data

Sep. 13, 1996 [DE] Germany ..... 296 15 823.2 U

[51] Int. Cl.[6] ..... D21F 1/52

[52] U.S. Cl. ..... 162/374; 162/353; 162/366

[58] Field of Search ..... 162/352, 374, 162/353, 364, 366

[56] References Cited

U.S. PATENT DOCUMENTS

| | | | |
|---|---|---|---|
| 3,265,560 | 8/1966 | Sager | 162/374 |
| 4,315,799 | 2/1982 | Turek et al. | 162/353 |
| 4,957,598 | 9/1990 | Corbellini | 162/363 |
| 5,076,894 | 12/1991 | Simmons et al. | 162/374 |

FOREIGN PATENT DOCUMENTS 233618 4/1911 Germany .

*Primary Examiner*—Karen M. Hastings
*Attorney, Agent, or Firm*—Ostrolenk, Faber, Gerb & Soffen, LLP

[57] ABSTRACT

A suction box for a machine for manufacturing a fiber web extends transverse to the travel direction of a porous belt and applies suction to the belt and the fiber suspension on the belt. The suction box has an open side toward the belt. At least two and more usually a plurality of support strips contact and extend transverse to the travel direction of the belt. Each adjacent pair of strips defines a suction slot. At one or both lateral side zones of the belt, a respective filler limits each slot, and the fillers establish the length of the slot across the belt. A respective filler extension extends inward from each of the fillers. The extensions are pervious to the fluids being suctioned, such as water and air, by being narrowed or wedge shaped or by being perforated. The fillers with their extensions are adjustable in position transverse to the direction of travel.

9 Claims, 1 Drawing Sheet

SUCTION BOX WITH SIDE FILLERS

BACKGROUND OF THE INVENTION

The present invention relates to a suction box for the use in a section of a machine for the manufacturing a fiber web, for instance a paper web, and particularly to regulating the size of the suction entry toward the belt carrying the fiber web to which suction is being applied.

A suction box of a similar type is disclosed in Federal Republic of Germany Patent 1937740.

In a paper manufacturing machine, such a suction box is used in the forming section of the machine for removing water from a fiber suspension for a paper web which is being formed either on a wire belt or between two wire belts called wires. The wire or wires travel over the inlet side of the suction box, together with the fiber web or the web of paper from which the water is to be removed. The vacuum in the suction box helps to remove water from the fiber or paper web passing over the box. The suction box is not restricted to use in a forming section, but may be used for other sections where suction is to be applied to a moving belt. The belt may be a wire or may be a felt or fabric belt, but is a belt suitable for the respective section of the machine.

The suction box has at least two spaced apart support strips, and typically has more than two support strips, which come into contact with the wire belt, or with one of the two wire belts. There is a suction slot defined between every two support strips. In DE '740, the length of a suction slot, and thus the length of the suction zone, is determined by two sealing strips. In other known constructions, slot fillers are fitted in sealing manner between adjacent support strips on each lateral end of the suction box, i.e. in the regions on both sides of the wire belt. The placement of the fillers determines the length of the respective suction zones in the direction across the wire. If necessary, at least some of the fillers can be shifted transversely to the direction of travel of the wire belt, in order to change the length of the respective suction zones across the wire. Such fillers are generally referred to as format slides.

The above DE '740 is concerned inter alia with the problem of reducing wearing of the wire and on the support strips. This wear is caused by the wire belt or in other cases a felt belt, travelling in direct contact over the support strips of the suction box. In DE '740, this wear is reduced by reducing the distance between the support strips as much as possible. In actual practice, however, at times there is still premature wear of the wire belt, particularly in the regions toward the lateral sides of the wire belt.

SUMMARY OF THE INVENTION

The invention concerns a suction box for a machine for manufacturing a fiber web which extends transverse to the travel direction of a porous belt and applies suction to the belt and the fiber suspension on the belt. The suction box has an open side toward the belt. At least two and more usually a plurality of support strips contact and extend transverse to the travel direction of the belt. Each adjacent pair of strips defines a suction slot. At one or both lateral side zones of the belt, a respective filler limits each slot, and the fillers establish the length of the slot across the belt. A respective filler extension extends inward from each of the fillers. The extensions are pervious to the fluids being suctioned, such as water and air, by being narrowed or wedge shaped or by being perforated. The fillers with their extensions are adjustable in position transverse to the direction of travel.

The object of the present invention is therefore to reduce premature wear of the wire or felt belt, particularly in the lateral side regions, as much as possible.

This object is achieved by the use of filler extensions at the ends of the suction slots across the wire. Although the respective fillers at the ends of the slots are impervious to fluids, the filter extensions are pervious to the fluids being sucked into the suction slots. The filler extensions which extend in the direction toward the center of the wire (or felt) belt, support the side regions of the wire (or felt) belt better than previously. Therefore, the lateral side regions of the wire (or felt) belt are not drawn into the suction slot or slots by the vacuum in the box. The extensions of the fillers are pervious to fluids and therefore, particularly, pervious to air and water. As a result, despite the improved support provided to the side regions of the wire or felt belt by the extensions, the length of the suction zone measured transverse to the direction of travel of the wire or felt belt is not reduced in that fluid passes the supporting extensions.

The fluid permeability of the filler extensions can be obtained in various ways. For example, the extensions can be developed in a wedge shape as seen from above so that their narrowed profiles provide fluid pervious spaces and/or the extensions can be perforated.

Other features and advantages of the present invention will become apparent from the following description of the invention which refers to the accompanying drawings.

DETAILED DESCRIPTION OF THE PREFERRED EMBODIMENT

Figure 1:
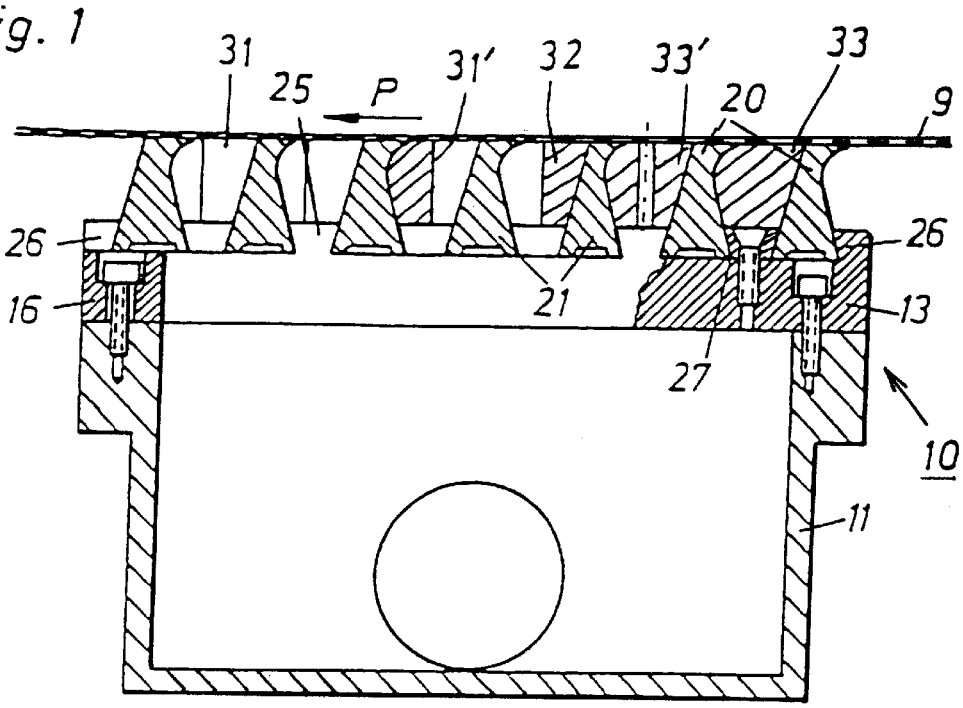
FIG. 1 is a cross section through a suction box along the line I—I of FIG. 2.

A suction box of the invention is used in association with a porous or mesh belt 9, e.g., a wire belt of a paper making machine forming section, to apply suction through the belt to a fiber web on the opposite side of the belt.

The suction box includes a trough 11, to which a vacuum source (not shown) may be connected. It includes a few support bars 13 arranged transversely on the trough, that is, along the path of the wire 9 and includes support strips 20 which extend along the length direction of the trough, which direction is transverse to the travel direction of P of the porous belt, e.g. a wire 9 of a forming section of a paper making machine. The traveling wire 9 comes into direct contact with the top edges of the support strips 20. Fastening elements 25, 26 and 27 fasten the support strips 20 on the support bars 13 which extend past the strips 20. Sealing strips 16 extend between the ends of the support bars 13.

Figure 2:
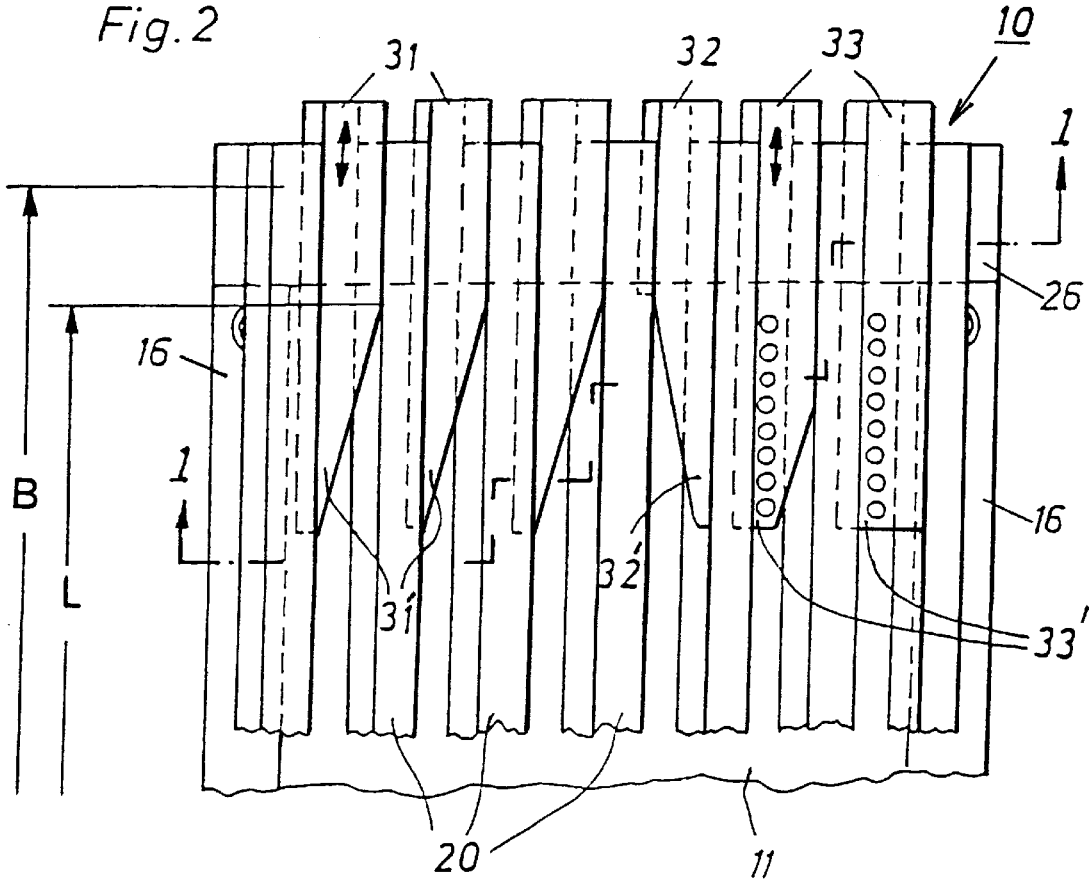
FIG. 2 is a top view on the suction box of FIG. 1.

In FIG. 2, the wire belt 9 has the width B. The length of each suction slot remaining between each pair of the support strips 20, i.e. the so-called suction-zone length across the wire and transverse to the wire path is designated L. It is determined by fillers 31, 32, 33 which are fitted in sealing manner between the support strips 20. The fillers are at least one end of the slots but usually at both ends, although one end of the slots is shown.

Each of the fillers 31 to 33 has a respective extension 31' to 33'. Starting from the end of the suction-zone length L, these extensions extend in the direction toward the center of the wire. Each of the fillers and its corresponding extension comes into direct contact with the wire belt 9 in the same manner as the support strips 20. However, as seen in the top view of FIG. 2, the extensions are either narrowed in width with reference to their fillers, e.g. tapered in wedge shape (see 31' or 32'), or are perforated (see 33'). It is also possible to provide both a wedge shaped tapering and a perforations as seen at one extension 33'.

If the length of the suction zone must be changed, the position of the fillers 31 to 33 together with the extensions 31' to 33' can be adjusted along a path parallel to the support strips 20. Fillers with extensions at both ends of the slots can be correspondingly adjusted.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A suction box in a machine for manufacturing a fiber web wherein the machine includes a porous belt which travels in a travel direction and the belt is structured and supported to contact the fiber web on one surface of the belt;

the suction box including a trough having an open side which is at and opens toward the surface of the belt opposite the surface in contact with the fiber web, so that the suction box may apply a suction force on and through the porous belt and on the web, the suction box open side having a dimension along the travel direction of the belt and having a length traverse to the direction of the travel of the porous belt;

at least two support strips at the open side of the box, positioned for contacting the belt, extending transverse to the direction of travel of the belt, and spaced apart along the at least two support strips at the open side of the box, positioned for contacting the belt, extending transverse to the direction of travel of the belt, and spaced apart along the travel direction for defining a suction slot between each two adjacent cones of the support strips;

each suction slot having lateral sides toward the lateral sides of the belt, and the belt having lateral side zones, a respective filler at at least one lateral side o the belt sealing to the respective support strips defining out of the suction slots and defining that slot at the respective lateral side zone of the belt; the fillers extending in the transverse direction toward the middle of the belt, but being spaced from the middle of the belt so that the fillers determine a length for the suction zone which is less than the width of the belt;

each filler having an extension starting at the respective lateral side of the suction slot at the filler and the extension extending toward the middle of the belt and also being oriented as to contact the belt moving past, each extension is narrower in width than the respective suction slot making the extension pervious to fluid as the suction box sucks the fluid past the narrower width of the extension.

2. The suction box of claim 1, wherein there are a plurality of the support strips extending transverse to the belt and arrayed spaced along the travel direction of the belt with a respective suction slot being defined between each adjacent pair of support strips;

a respective one of the fillers at at least one lateral side in each suction slot and a respective extensions for each of the fillers.

3. The suction box of claim 2, wherein at least one of the fillers, including the extension thereof, is adjustable in position transverse to the direction of travel of the belt so as to change the length of the respective suction zone transverse to the travel direction of the belt.

4. The suction box of claim 2, wherein there is a respective filler and its extension at both lateral sides of each suction slot.

5. The suction box of claim 1, wherein at least one of the fillers, and the extension thereof, is adjustable in position transverse to the direction of travel of the belt so as to change the length of the respective suction zone transverse to the travel direction of the belt.

6. The suction box of claim 5, wherein the fillers including the extension are adjustable transverse of the direction of travel of the belt.

7. A suction box in a machine for manufacturing a fiber web wherein the machine includes a porous belt which travels in a travel direction and the belt is structured and supported to contact the fiber web on one surface of the belt;

the suction box including a trough having an open side which is at and opens toward the surface of the belt opposite the surface in contact with the fiber web, so that the suction box may apply a suction force on and through the porous belt and on the web, the suction box open side having a dimension along the travel direction of the belt and having a length traverse to the direction of the travel of the porous belt;

at least two support strips at the open side of the box, positioned for contacting the belt, extending transverse to the direction of travel of the belt, and spaced apart along the travel direction for defining a suction slot between each two adjacent cones of the support strips;

each suction slot having lateral sides toward the lateral sides of the belt, and the belt having lateral side zones, a respective filler at at least one lateral side o the belt sealing to the respective support strips defining out of the suction slots and defining that slot at the respective lateral side zone of the belt; the fillers extending in the transverse direction toward the middle of the belt, but being spaced from the middle of the belt so that the fillers determine a length for the suction zone which is less than the width of the belt;

each filler having an extension starting at the respective lateral side of the suction slot at the filler and the extension extending toward the middle of the belt and also being oriented as to contact the belt moving past, the extension having a generally wedge shape tapering toward the middle of the belt as seen from above, making the extension pervious to the passage of a fluid thereby as the suction box sucks the fluid.

8. A suction box in a machine for manufacturing a fiber web wherein the machine includes a porous belt which travels in a travel direction and the belt is structured and supported to contact the fiber web on one surface of the belt;

the suction box including a trough having an open side which is at and opens toward the surface of the belt opposite the surface in contact with the fiber web, so that the suction box may apply a suction force on and through the porous belt and on the web, the suction box open side having a dimension along the travel direction of the belt and having a length traverse to the direction of the travel of the porous belt;

at least two support strips at the open side of the box, positioned for contacting the belt, extending transverse to the direction of travel of the belt, and spaced apart along the travel direction for defining a suction slot between each two adjacent cones of the support strips;

each suction slot having lateral sides toward the lateral sides of the belt, and the belt having lateral side zones, a respective filler at at least one lateral side o the belt sealing to the respective support strips defining out of the suction slots and defining that slot at the respective lateral side zone of the belt; the fillers extending in the transverse direction toward the middle of the belt, but being spaced from the middle of the belt so that the fillers determine a length for the suction zone which is less than the width of the belt;

each filler having an extension starting at the respective lateral side of the suction slot at the filler and the extension extending toward the middle of the belt and also being oriented as to contact the belt moving past, the extension having a generally wedge shape tapering toward the middle of the belt as seen from above, and having perforations at locations along its length toward the middle of the belt making the extension pervious to the passage of fluid thereby as the suction box sucks the fluid.

9. The suction box of claim 7, wherein at least one of the fillers and the extension thereof is adjustable in position transverse to the direction of travel of the belt so as to change the length of the respective suction zone transverse to the travel direction of the belt.

* * * * *